US007594350B2

(12) United States Patent
Yang

(10) Patent No.: US 7,594,350 B2
(45) Date of Patent: Sep. 29, 2009

(54) PICTURE FRAME

(76) Inventor: Chin-Sheng Yang, 4F., No. 26, Lane 358, Yung-An St., Tainan City (TW)

( * ) Notice: Subject to any disclaimer, the term of this patent is extended or adjusted under 35 U.S.C. 154(b) by 0 days.

(21) Appl. No.: 12/241,076

(22) Filed: Sep. 30, 2008

(65) Prior Publication Data

US 2009/0133300 A1 May 28, 2009

(30) Foreign Application Priority Data

Nov. 26, 2007 (TW) ..... 96219932 A

(51) Int. Cl.
*G09F 19/00* (2006.01)

(52) U.S. Cl. ..... 40/737; 40/406; 40/409

(58) Field of Classification Search ..... 40/406–410, 40/737, 798, 714; 446/267
See application file for complete search history.

(56) References Cited

U.S. PATENT DOCUMENTS 4,757,625 A * 7/1988 Watkins ..... 40/406
D375,411 S * 11/1996 Hawkins ..... D6/314
5,853,824 A * 12/1998 Liu ..... 428/11
6,027,774 A * 2/2000 Fine et al. ..... 428/14
6,357,151 B1 * 3/2002 Yuen ..... 40/406
7,430,823 B1 * 10/2008 Chung ..... 40/409

FOREIGN PATENT DOCUMENTS

JP 07298968 A * 11/1995

* cited by examiner

*Primary Examiner*—Cassandra Davis
(74) *Attorney, Agent, or Firm*—Leong C. Lei

(57) ABSTRACT

A picture frame which contains a base member and a frame member that is pervious to light. The base member has a top opening exposing an internal space inside. A driving motor and at least a light generating element are housed inside the internal space of the base member. The frame member has a channel circling a window area which is filled with a fluid dispersed with spangles. The driving motor turns a magnetic element, which in turn drives a magnetically driven element with vanes inside the channel. The vanes propel the fluid and the spangles in the fluid to circle along the channel. The floating and moving spangles around the photo or picture in the window area, together with the light produced by the light generating element, therefore produce an appealing visual effect.

6 Claims, 3 Drawing Sheets

PICTURE FRAME

TECHNICAL FIELD OF THE INVENTION

The present invention generally relates to picture or photo frames, and more particularly to a picture frame having visually appealing fluid and spangles circulating around the picture or photo.

DESCRIPTION OF THE PRIOR ART

Picture or photo frames, whether they are put on a table top or hung on the wall, are common in households as a decoration or for adding some style to the interior of the house. However, conventional frames at most have some static ornamental designs around the window area of the frame, which is quite dull.

SUMMARY OF THE INVENTION

Accordingly, a novel picture frame is provided herein, which contains a base member and a frame member that is pervious to light. The base member has a top opening exposing an internal space inside. A driving motor and at least a light generating element are housed inside the internal space of the base member. The frame member has a channel circling a window area which is filled with a fluid dispersed with spangles or similar glittery elements. The driving motor turns a magnetic element positioned at a top end of the driving motor's axle, which in turn rotates a magnetically driven element with one or more vanes in the channel. The vanes propel the fluid and the spangles in the fluid to flow and to circle along the channel. The floating and moving spangles around the photo or picture in the window area, together with the light produced by the light generating element therefore produce an appealing visual effect.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
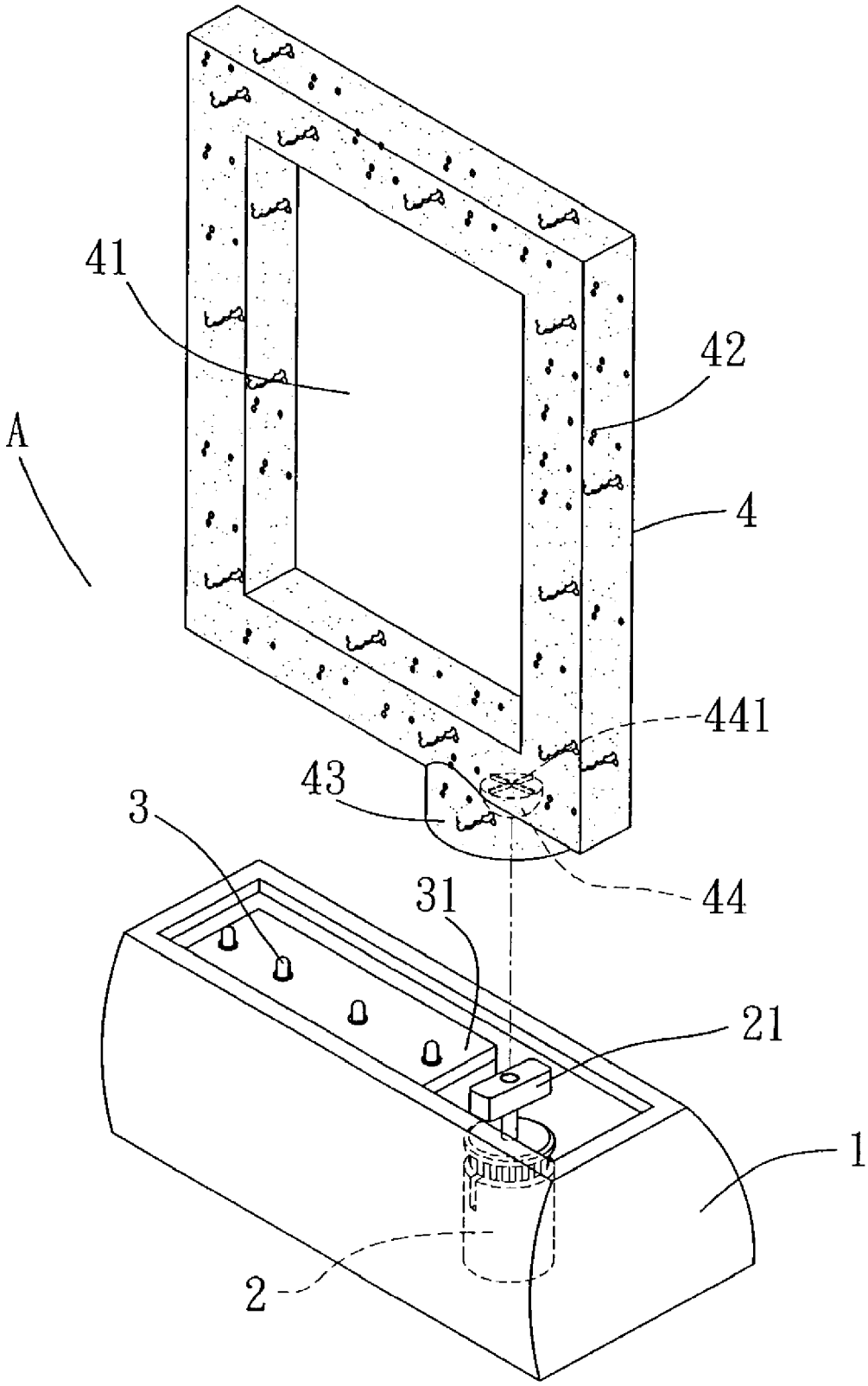
FIG. 1 is a perspective diagram showing the various components of a picture frame according an embodiment of the present invention.

As shown in FIG. 1, a picture frame A according to an embodiment of the present invention mainly contains a base member 1, a driving motor 2, at least a light generating element 3, and a frame member 4 that is pervious to light.

The base member 1 has a top opening exposing an internal space inside.

The driving motor 2 is housed inside the internal space of the base member 1 with its axle extended vertically upward. A magnetic element 21 is positioned at a top end of the driving motor 2's axle that is turned along with the axle.

Also housed inside the internal space of the base member 1 are a circuit member 31 and the light generating elements 3 are positioned on a top surface of the power member 31 and exposed from the top opening of the base member 1.

The frame member 4 surrounds a window area 41 and, inside the frame member 4, there is a channel 42 circling the window area 41. The channel 42 is filled with a fluid dispersed with spangles or similar glittery elements.

Figure 2:
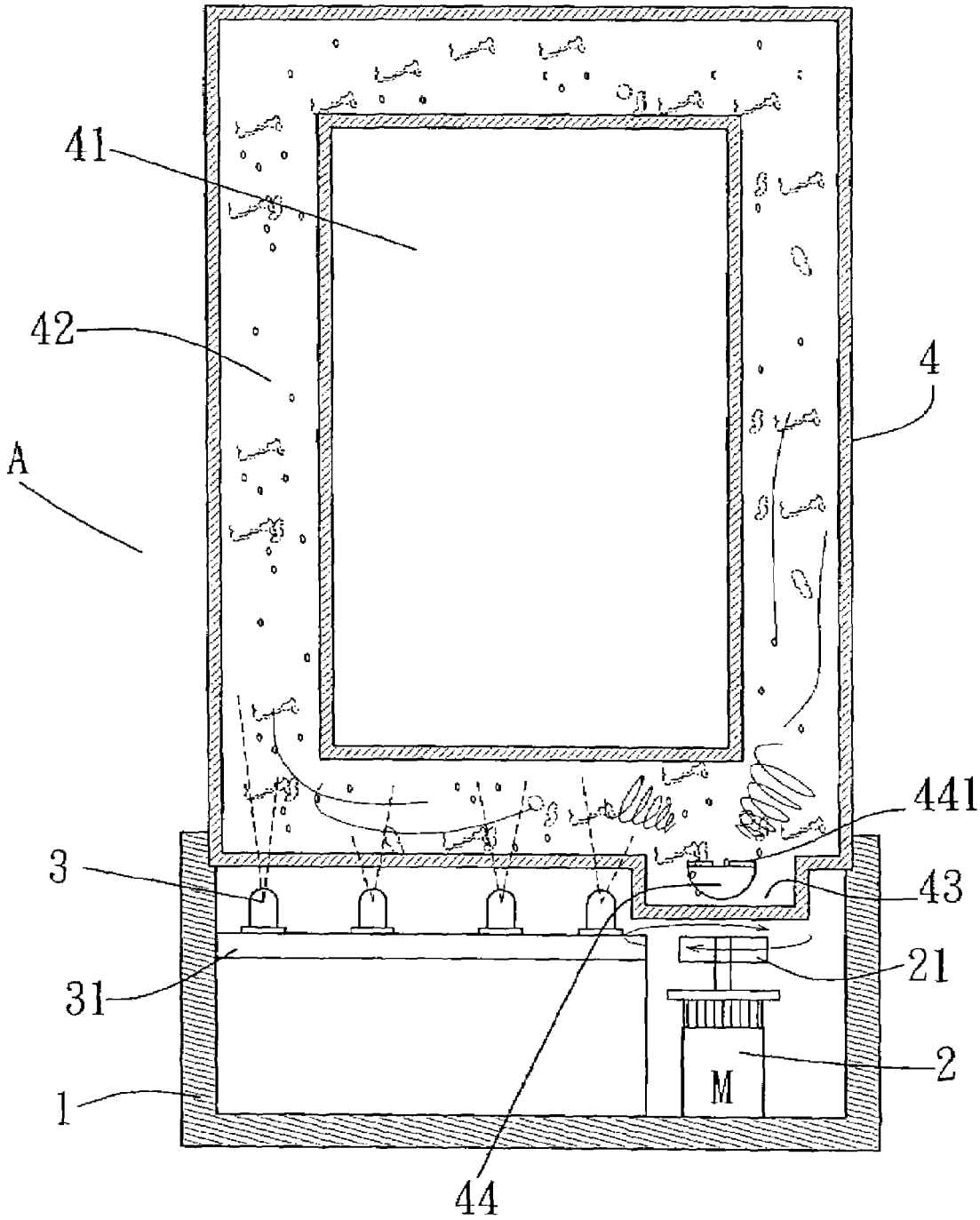
FIG. 2 is a sectional diagram showing the picture frame of FIG. 1.

As shown in FIG. 2, the frame member 4 is plugged into the top opening of the base member 1 and a photo or a picture is embedded in the window area 41 of the frame member 4. The frame member 4 and its channel 42 are configured such that a section along a bottom edge of the channel 42 above the driving motor 2 is extended downward to form a chamber 43 within which a magnetically driven element 44 with one or more vanes 441 is housed in the chamber 43.

The driving motor 2 is connected to the power member 31 and, when the power member 31 is turned on, the driving motor 2 receives electricity from the power member 31 and its axle as well as the magnetic element 21 is turned. Due to the magnetic force of the magnetic element 21, the magnetically driven element 44 inside the chamber 43 is turned as well. The vanes 441 of the magnetically driven element 44 propel the fluid and the spangles in the fluid to flow and to circle along the channel 42. The floating and moving spangles around the photo or picture therefore produce an appealing visual effect.

When the power member 31 is turned on, the light generating elements 3, such as light emitting diodes or light bulbs, are also turned on or flashed. The picture or photo in the window area 41 is thereby illuminated. Additionally, as light is reflected from the spangles, even more appealing visual effect is produced.

Figure 3:
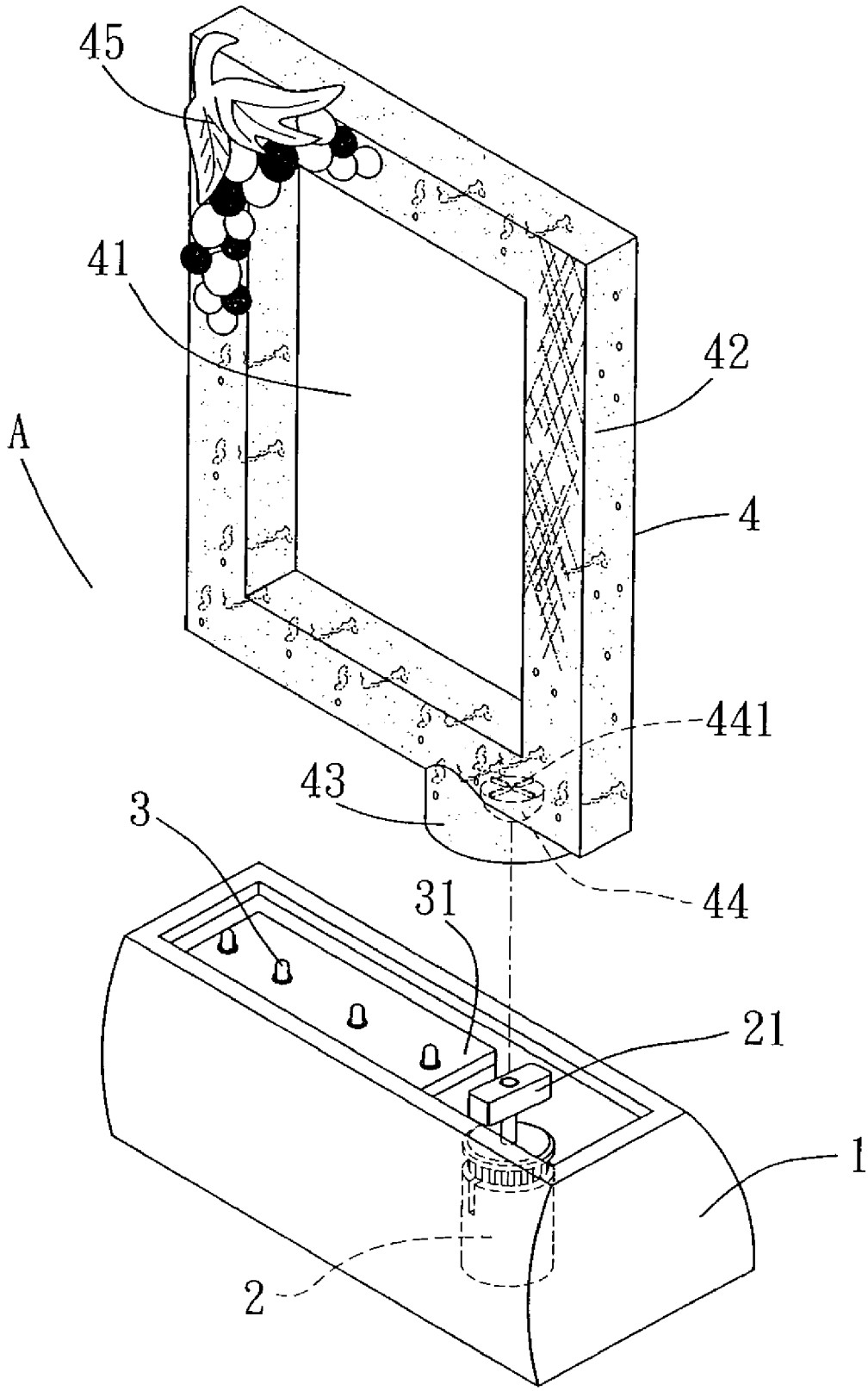
FIG. 3 is a perspective diagram showing a picture frame according to another embodiment of the present invention.

As illustrated in FIG. 3, the frame member 4 could further have ornamental element 45 at an appropriate location of the frame member 4. The ornamental element 45 could be an embossed three-dimensional object or a two-dimensional graphical pattern attached to or printed on the frame member 4.

According the foregoing description, the picture frame of the present invention has a number of distinguished features. The fluid with glittery spangles is propelled to circulate around the picture or photo and, together with the illumination by the light generating elements 3, an appealing visual effect is produced. Most significantly, non-contact magnetic force is applied to propel the fluid so that the frame member 4 could be easily positioned on and removed from the base member 1 for the replacement of a picture or photo.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the sprint of the present invention.

I claim:

1. A picture frame, comprising:

a base member having a top opening exposing an internal space of said base member;

a frame member pervious to light positioned in said top opening of said base member, said frame member surrounding a window area and having a channel inside circling said window area, said channel filled with a fluid;

a driving motor, a circuit member, and at least a light generating element inside said internal space and beneath said frame member, said driving motor and said light generating element powered by said circuit member, said driving motor having an axle extended vertically upward with a magnetic element at a top end of said axle; wherein said channel has a chamber above said driving motor; a magnetically driven element is positioned inside said chamber; and, when said magnetic element is turned by said axle, said magnetically driven element is turned as well by said magnetic element through magnetic force to propel said fluid to circulate along said channel.

2. The picture frame according to claim 1, wherein fluid is dispersed with a plurality of spangles.

3. The picture frame according to claim 1, wherein said light generating element is a light emitting diode.

4. The picture frame according to claim 1, wherein said light generating element is a light bulb.

5. The picture frame according to claim 1, wherein said magnetically driven element has at least a vane on a top surface of said magnetically driven element.

6. The picture frame according to claim 1, wherein said frame member has an ornamental element.

* * * * *